US007578693B2

(12) United States Patent
Yoshida et al.

(10) Patent No.: US 7,578,693 B2
(45) Date of Patent: Aug. 25, 2009

(54) CONNECTOR UNIT

(75) Inventors: Haruki Yoshida, Shizuoka (JP); Sumito Atsumi, Shizuoka (JP); Eiji Fukuda, Shizuoka (JP); Hiroshi Kobayashi, Aichi (JP); Kiyoka Matsubayashi, Aichi (JP); Fumitoshi Akaike, Aichi (JP); Masatoshi Mori, Aichi (JP)

(73) Assignees: Yazaki Corporation, Tokyo (JP); Toyota Boshoku Kabushiki Kaisha, Kariya-shi (JP)

( * ) Notice: Subject to any disclaimer, the term of this patent is extended or adjusted under 35 U.S.C. 154(b) by 185 days.

(21) Appl. No.: 11/893,730

(22) Filed: Aug. 17, 2007

(65) Prior Publication Data

US 2008/0048479 A1 Feb. 28, 2008

(30) Foreign Application Priority Data

Aug. 23, 2006 (JP) ..... 2006-226580

(51) Int. Cl.
*H01R 13/627* (2006.01)

(52) U.S. Cl. ..... 439/352; 439/701; 439/357

(58) Field of Classification Search ..... 439/352, 439/357, 701

See application file for complete search history.

(56) References Cited

U.S. PATENT DOCUMENTS 6,231,368 B1 * 5/2001 Murakami et al. ..... 439/352
6,475,015 B1 * 11/2002 Murakami et al. ..... 439/352
6,514,099 B2 * 2/2003 Endo ..... 439/489
6,595,793 B2 * 7/2003 Tsuji et al. ..... 439/352

FOREIGN PATENT DOCUMENTS

JP 2003-299549 10/2003

* cited by examiner

*Primary Examiner*—Tho D Ta
(74) *Attorney, Agent, or Firm*—Kratz, Quintos & Hanson, LLP

(57) ABSTRACT

The connector unit includes: a first holder to be attached to a first article; a first connector to be received in the first holder; a second holder to be attached to a second article; and a second connector to be received in the second holder to be coupled with the first connector, wherein the first holder includes a hold engaging part having an arm body and a projection which engages with the first connector, the connector unit further includes: an engagement-removing part which removes an engagement between the hold engaging part and the first connector when the first and second connectors are coupled with eachother; and an entrance-permitting part provided on the second holder to allow the projection of the disengaged hold engaging part to enter therein after the first and second connectors move with respect to the first holder.

4 Claims, 20 Drawing Sheets

CONNECTOR UNIT

BACKGROUND OF THE INVENTION (1) Field of the Invention

The present invention relates to a connector unit including connectors for connecting electric wires and the like.

(2) Description of the Related Art

To a head rest of a motor vehicle as a mobile unit, attached is various electronic equipment such as a monitor and a whiplash preventing apparatus for preventing whiplash occurring upon collision. So far, various connector units (for example, see Japanese Patent Application Laid-Open 2003-299549) have been used to supply desired electric power and signals to electronic equipment attached to such a head rest.

A connector unit described in Japanese Patent Application Laid-Open 2003-299549 includes: a tube-shaped holder as a receiving member attached to a seat as a first article; a connector received in the holder; a pole attached to a head rest as a second article; and a mating connector attached to an end of the pole. The connector unit is assembled by inserting the pole into the holder and coupling the connector with the mating connector. The assembled connector unit connects electronic equipment located on the side of a vehicle body of a motor vehicle with electronic equipment located on the side of the head rest through the connector and the mating connector connected to each other so as to transmit desired electric power and signals to the electronic equipment located on the side of the head rest.

As for the connector unit described above, on a condition that the seat and the head rest are attached to each other, there is a case in which an engaging part for tentatively holding the connector in the holder is left being resiliently deformed in a direction, in which its engagement with the connector is removed. In such a case, when the engaging part is used for a long period of time, the engaging part is subjected to plastic deformation, resulting in that when the head rest and the seat are detached from each other, the engaging part possibly fails to engage with the connector and therefore, the connector drops out from the holder.

SUMMARY OF THE INVENTION

It is therefore an objective of the present invention to solve the above problem and to provide a connector unit, by which the connector is prevented from dropping out from the holder even when the first article and the second article are detached from each other.

In order to attain the above objective, the present invention is to provide a connector unit including: a first holder to be attached to a first article; a first connector to be received in the first holder; a second holder to be attached to a second article; and a second connector to be received in the second holder so as to be coupled with the first connector, wherein the first holder includes a hold engaging part having an arm body and a projection, which projects from the arm body toward the first connector and engages with the first connector, the connector unit further including: an engagement-removing part which removes an engagement between the hold engaging part and the first connector when the first and second connectors are coupled with each other, so as to allow the first and second connectors to move with respect to the first holder; and an entrance-permitting part which is provided on the second holder so as to allow the projection of the hold engaging part, the engagement of which with the first connector is removed, to enter therein after the first and second connectors move with respect to the first holder.

With the construction described above, the second holder is provided with the entrance-permitting part, into which the projection of the hold engaging part enters when the connectors are coupled with each other and therefore the first and second articles are attached to each other. Thereby, the projection enters the entrance-permitting part so as to prevent the hold engaging part from being resiliently deformed even if the hold engaging part is subjected to resilient deformation when the connectors are coupled with each other. Therefore, the hold engaging part can be prevented from being plastically deformed. Therefore, even when the first and second articles are detached from each other, the hold engaging part securely engages with the first connector, thereby preventing the first connector from dropping out from the first holder.

The connector unit further includes a part to be pressed which is formed in the second holder and is pressed by the projection of the hold engaging part, the engagement of which with the first connector is removed, when the first and second connectors move with respect to the first holder after the first and second connectors are coupled with each other.

With the construction described above, the second holder is provided with the part to be pressed which is pressed by the projection of the hold engaging part when the first and second articles are attached to each other. Thereby, the holders can be easily aligned with each other when the first and second articles are attached to each other. Therefore, the first and second articles can be easily positioned at the respective predetermined relative positions.

The first connector includes a first engaging part which is engagable with the hold engaging part and holds the first connector in the first holder by engaging with the hold engaging part, wherein the second connector includes a second engaging part which is engagable with the first engaging part and causes the first and second connectors to couple with each other by engaging with the first engaging part, wherein the engagement-removing part removes an engagement between the hold engaging part and the first engaging part when the first and second engaging parts engage with each other, so as to allow the first and second connectors engaging with each other to move with respect to the first holder.

With the construction described above, since the first and second connectors include the first and second engaging parts, respectively, therefore the first connector can be securely held in the first holder and the connectors can be securely kept being coupled with each other. Therefore, the connector can be prevented from abruptly dropping out.

DESCRIPTION OF THE PREFERRED EMBODIMENTS

In the following, preferred embodiments of the present invention will be explained with reference to FIGS. 1-20. A connector unit 1 shown in FIG. 1 is used to transmit desired electric power and signals to various electronic equipment such as a monitor and a whiplash preventing apparatus attached to a head rest in a motor vehicle.

Figure 1:
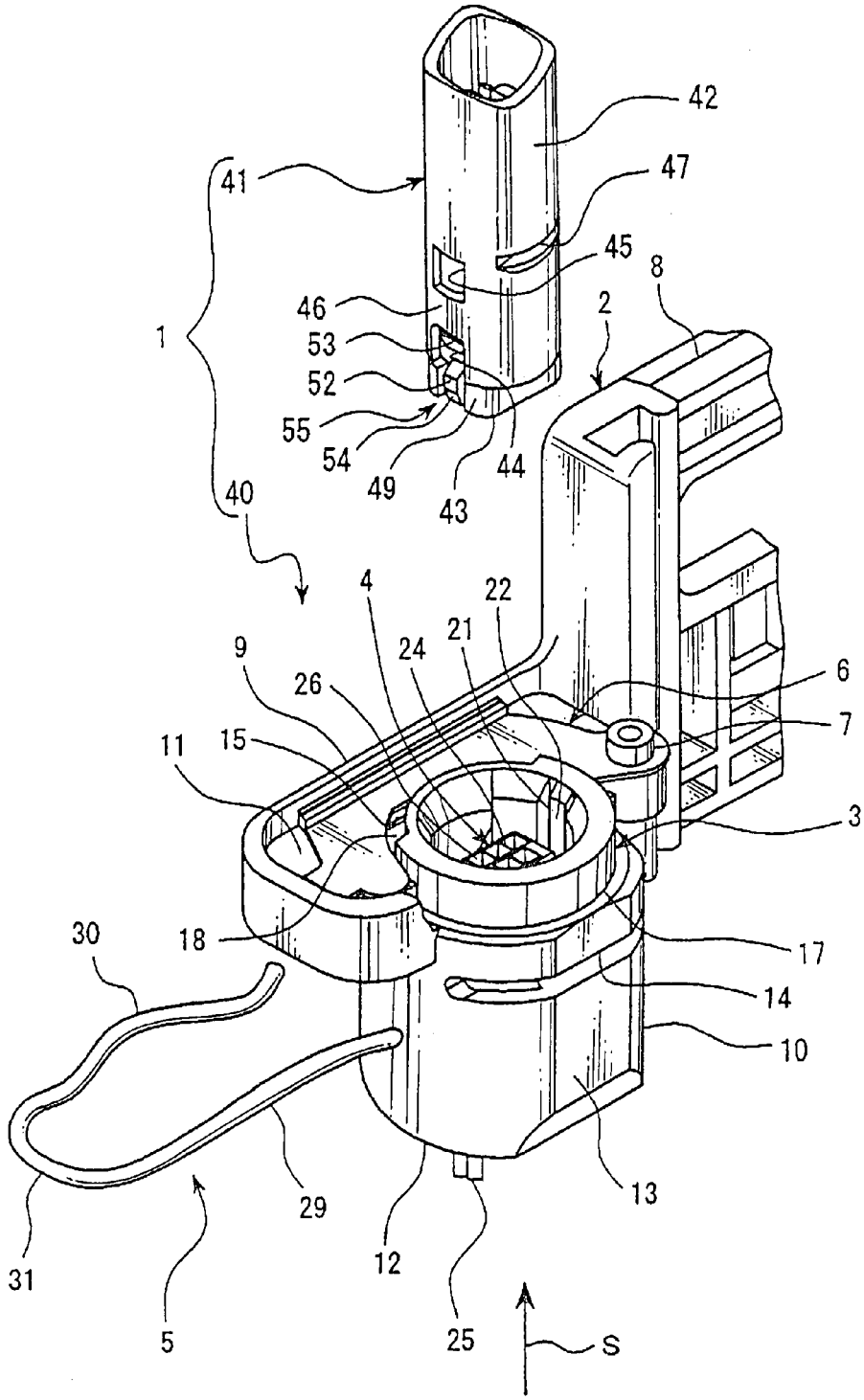
FIG. 1 is a perspective view of a connector unit according to a preferred embodiment of the present invention.
Figure 2:
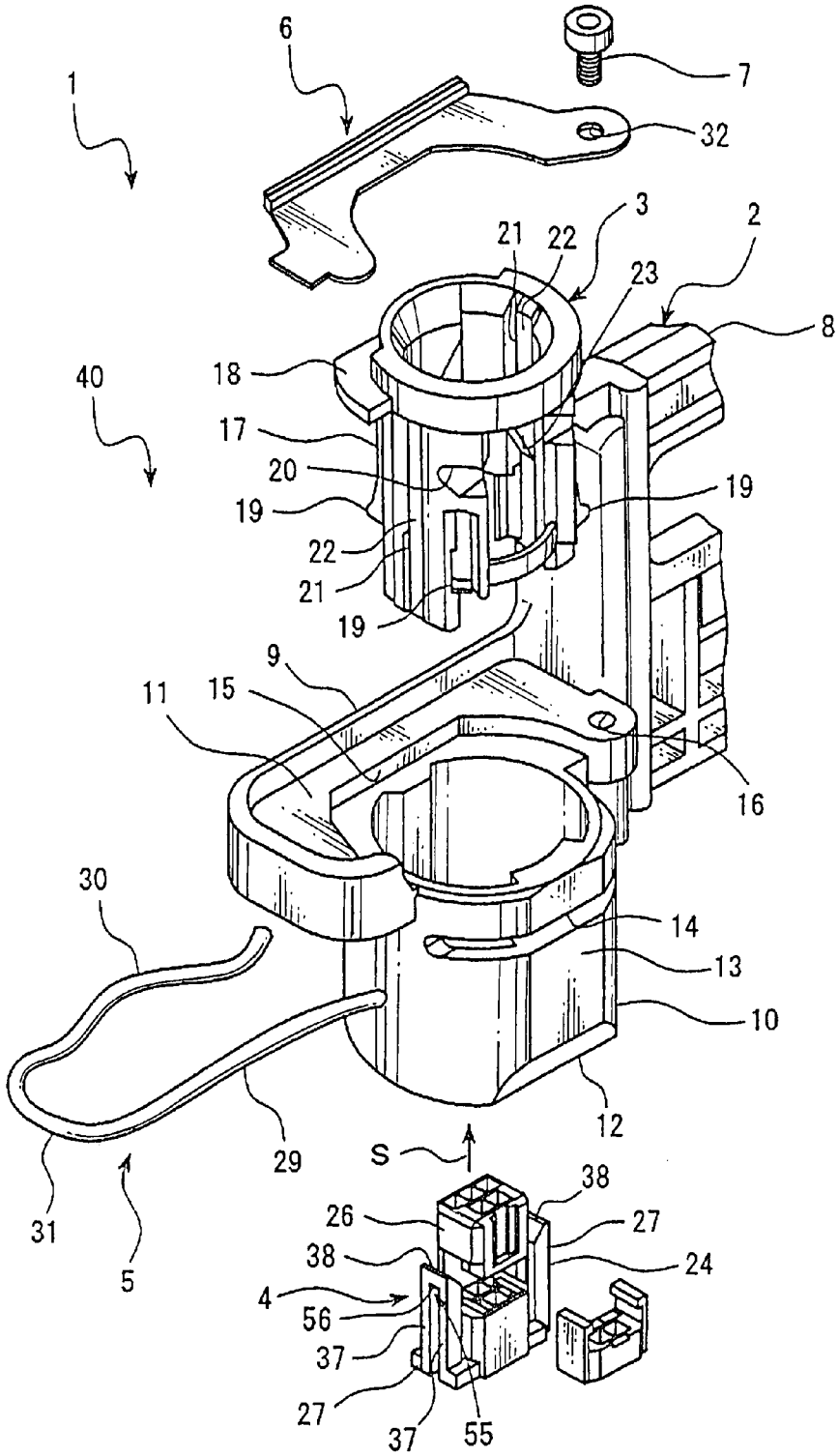
FIG. 2 is a perspective view illustrating the connector unit shown in FIG. 1 by disassembling the seat-side unit thereof.

As shown in FIGS. 1 and 2, the connector unit 1 includes a seat-side unit 40, head rest-side unit 41, and clip 5.

As shown in FIGS. 1 and 2, the seat-side unit 40 includes a bracket 2, holder 3, first connector 4, plate 6 (shown in FIG. 2) as a fixing member, and bolt 7 (shown in FIG. 2).

Figure 5:
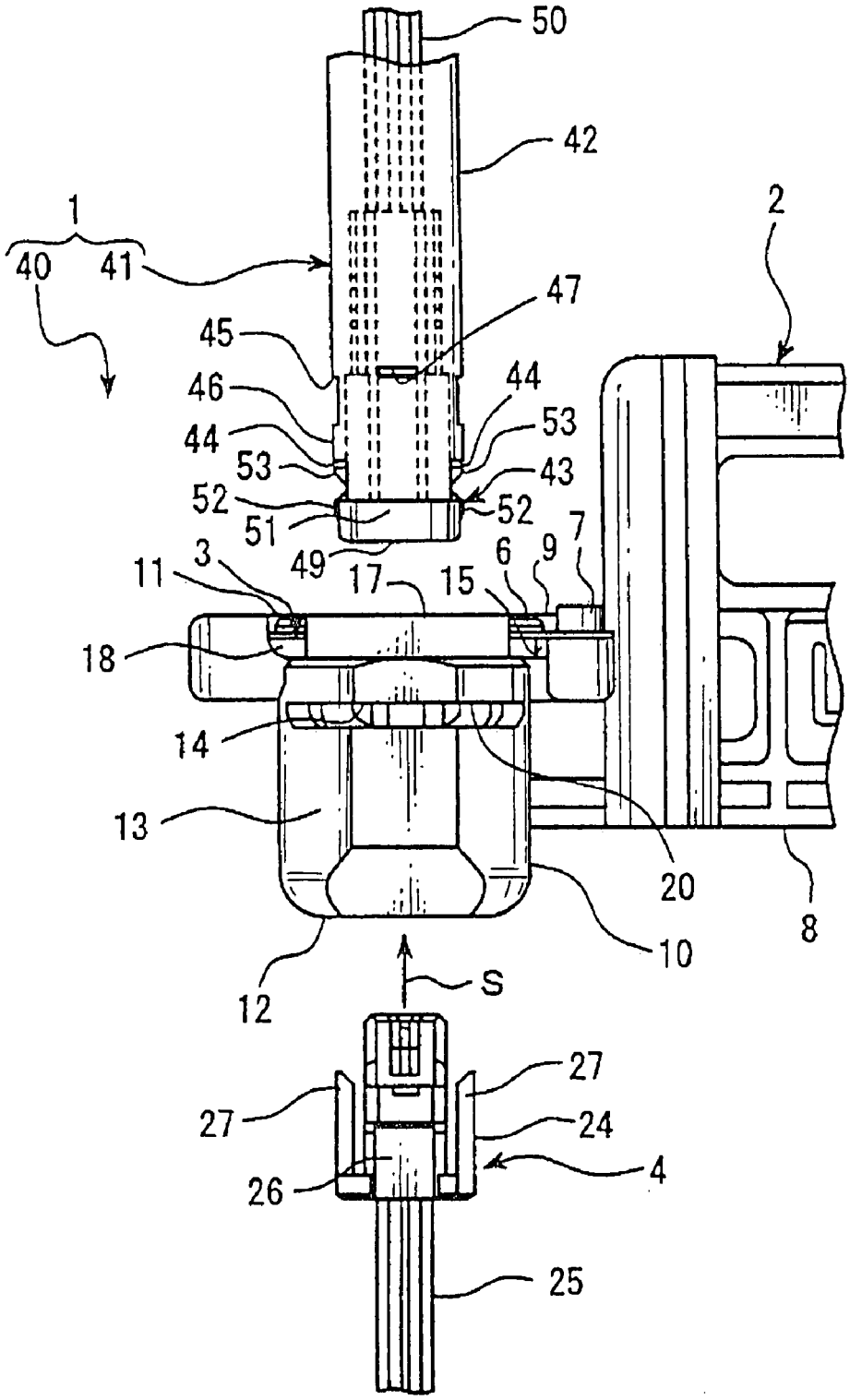
FIG. 5 is a front view illustrating a receiving part of the seat-side unit and the first connector of connector unit shown in FIG. 1.
Figure 6:
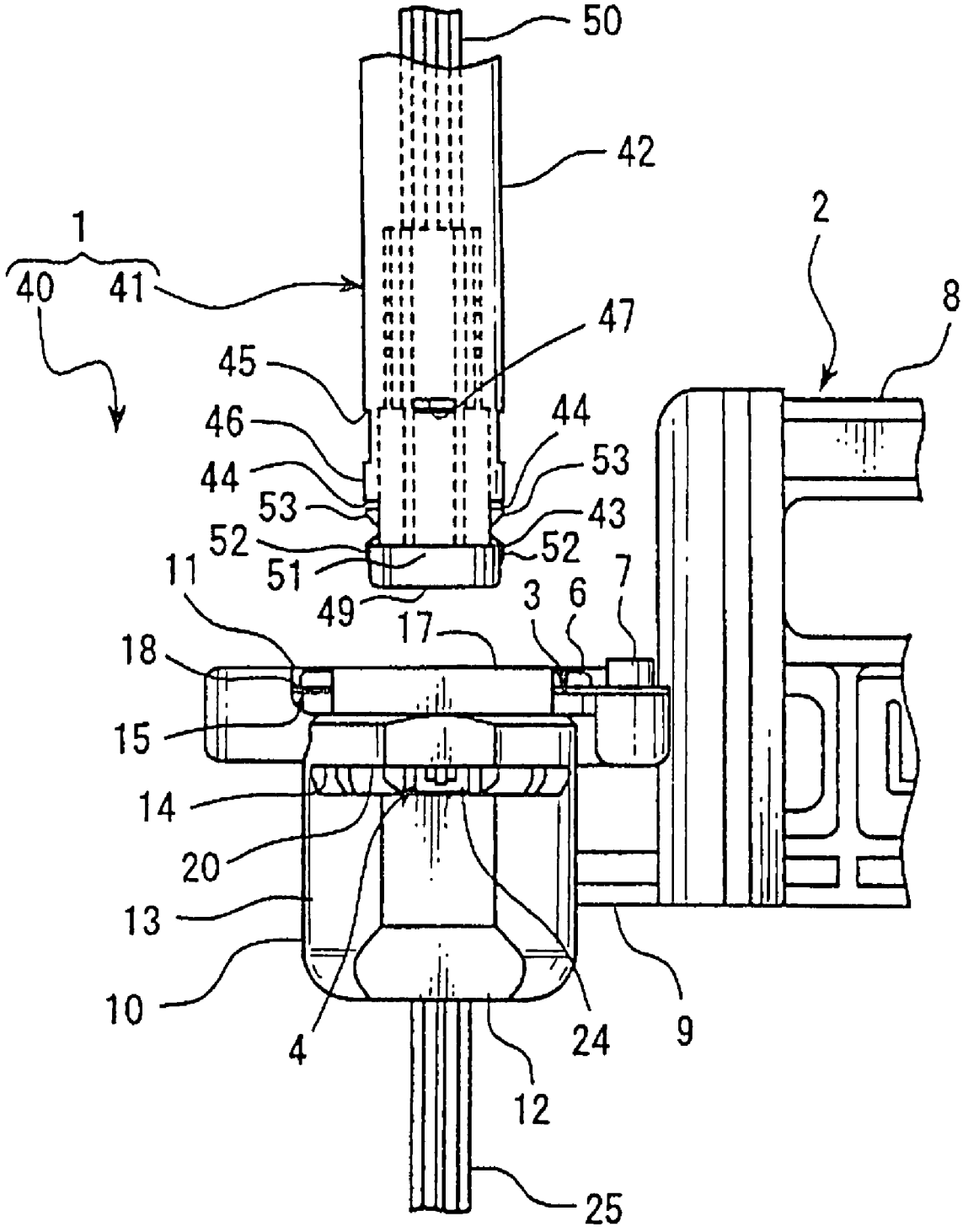
FIG. 6 is a front view illustrating a state when the first connector shown in FIG. 5 is held in the receiving part.

The bracket 2 is made of electrically insulating synthetic resin and attached to a seat as the first article of a motor vehicle. The bracket 2 includes a plate-shaped body part 8 and a pair of receiving parts 9. The body part 8 connects the pair of the receiving parts 9. The receiving parts 9 are arranged in parallel having a distance therebetween. The receiving part 9 includes a body part 10 and flange part 11. As shown in FIGS. 5 and 6, the body part 10 integrally includes a ring-shaped bottom plate 12 and a cylinder part 13 standing up from an outer edge of the bottom plate 12. The body part 10 is formed in a cylinder-shape having a bottom.

A straight hole 14 penetrates through the cylinder part 13. The straight hole 14 extends straight along a direction crossing at right angles an axis of the cylinder part 13, i.e. an axis of the body part 10 of the receiving part 9. The straight hole 14 communicates with both of a straight notch 20 (explained later) of the holder 3 and a straight hole 47 of a stay 42 (explained later). The body part 10 receives the holder 3 therein and holds the holder 3.

Flange part 11 is formed in a plate-shape and extends from an outer edge of the cylinder part 13 toward an outer peripheral direction of the cylinder part 13, said edge being situated away from the bottom plate 12. Flange part 11 is formed around about a half round of the outer edge of the cylinder part 13, said edge being situated away from the bottom plate 12. The flange part 11 is provided with a step 15 which makes the flange part 11 gradually thick as approaching the outer periphery of the flange part 11. Further, a bolt-passing hole 16 is formed at an end part of the flange part 11, said end part being in the proximity of the body part 8, and a nut communicating with the bolt-passing hole 16 and a threaded hole is embedded in said end part.

The holder 3 is made of electrically insulating synthetic resin and formed in a cylinder-shape as a whole. As shown in FIG. 2, the holder 3 integrally includes a cylindrical holder body 17 and flange part 18. The holder body 17 is formed in a cylinder-shape as a whole having a plurality of notches and holes. The holder body 17 is received in the body part 10. Therefore, the holder 3 is attached to a seat as the first article through the body part 10, i.e. through the bracket 2.

As shown in FIG. 2, the holder body 17 is provided with a plurality of resiliently deformable arms 19, straight notches 20, and holder locking arms 21 as the hold engaging parts. The resiliently deformable arm 19 is formed in a resiliently deformable rod, one end part of which continues to the holder body 17. An opposite end part of the resiliently deformable arm 19 is resiliently deformable in a direction of approaching or leaving the holder body 17. When the holder body 17 is received in the body part 10 of the receiving part 9, the opposite end part of the resiliently deformable arm 19 comes in contact with an inner surface of the cylinder part 13 of the body part 10 so as to be resiliently deformed, so that the resiliently deformable arm 19 holds the holder body 17 being movable in the body part 10 of the receiving part 9 and always biases the holder body 17 toward the center of the body part 10 of the receiving part 9.

The straight notch 20 is a hole communicating the inside with the outside of the holder body 17 and extends along a direction crossing at right angles an axis of the holder body 17 of the holder 3. When the holder body 17 of the holder 3 is received in the body part 10 of the receiving part 9, the straight notch 20 overlaps with the straight hole 14 so as to communicate with the straight hole 14.

In an example shown in the figure, a pair of the hold locking arms 21 are provided. The hold locking arms 21 are arranged facing each other putting the center of the holder body 17 therebetween. As shown in FIG. 2, each hold locking arm 21 includes a rod-shaped arm body 22 and a locking projection 23 as the projection. The arm body 22 is arranged such that the length direction of the arm body 22 is along the axis of the holder body 17. The arm body 22 is formed in a so-called twin shape, in which both end parts thereof in the length direction are formed integrally with the holder body 17 and a portion excepts said both end parts thereof is arranged being spaced from the holder body 17. The locking projection 23 is arranged at the center in the length direction of the arm body 22 and formed projecting from the arm body 22 in a direction in which the holder locking arms 21 approaching each other.

The flange part 18 is formed in a plate-shape and extends from one end part of the holder body 17 when the holder body 17 is received in the body part 10 of the receiving part 9, said end part being situated in the proximity of the flange part 11, toward the outer peripheral direction of the holder body 17. The flange part 18 is formed around about a half round of the one end part of the holder body 17.

As for the holder 3, the flange part 18 is placed on the flange part 11 of the receiving part 9, so that the holder body 17 is received in the body part 10 of the receiving part 9. The holder body 17 receives the first connector 4 therein and the holder locking arm 21 engages with a locking arm 27 (explained later) of the first connector 4, so that the holder 3 holds the first connector 4. The flange part 18 of the holder 3 is positioned inside the step 15 of the receiving part 9.

Figure 3:
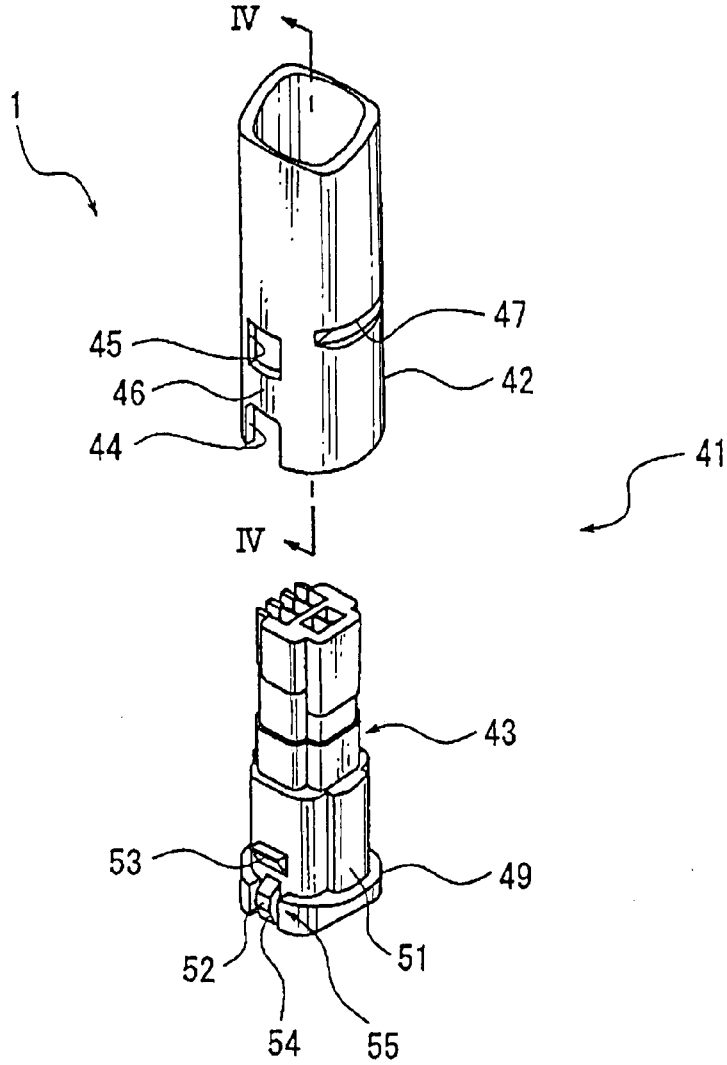
FIG. 3 is a perspective view illustrating the connector unit shown in FIG. 1 by disassembling the head rest-side unit thereof.

As shown in FIGS. 2 and 3, the first connector 4 includes a terminal fitting 36 (shown in FIG. 7) and a connector housing 24. The terminal fitting 36 is made of electrically conductive sheet metal. The terminal fitting 36 attaches an end of an electric wire 25 so as to be electrically connected to a core wire of the electric wire 25.

The connector housing 24 is made of electrically insulating synthetic resin and includes a box-shaped housing body 26 and a locking arm 27 as the first engaging part. The housing body 26 is provided with a plurality of terminal-receiving chambers each extending straight. A plurality of the terminal-receiving chambers are arranged in parallel to each other. Both ends of the terminal-receiving chamber are holes (spaces) which open on an outer surface of the housing body 26.

The connector housing 24 is provided with two locking arms 27. The locking arms 27 position the housing body 26 therebetween. Each locking arm 27 includes a pair of arm members 37 and a locking beak 35 which connects the arm members 37 to each other.

The arm members 37 each are formed in a rod-shape extending straight and arranged in parallel to each other having a distance therebetween. One end part of the arm member 37 continues to an end part of the housing body 26, said end part being situated away from the head rest-side unit 41. The arm member 37 extends from the one end part toward the head rest-side unit 41. The arm member 37 is arranged in parallel to the terminal-receiving chamber. The locking beak 38 connects opposite end parts of the arm members 37 to each other.

As for the locking arm 27, the locking projection 26 is positioned between the pair of the arm members 37 and the locking beak 38, and the holder locking arm 21 engages with the opposite end part of the locking arm 27. Thus, one end part of the locking arm 27 is formed in a cantilever-shape which continues to the housing body 26, said one end part being situated away from a second connector 43 (explained later) which engages with the first connector 4. The locking arm 27 is engagable with the holder locking arm 21 and holds the first connector 4 in the holder 3 by engaging with the holder locking arm 21.

The first connector 4 is inserted from the side situated away from the flange part 11 into the holder body 17 of the holder 3 so as to be received in the holder body 17. The locking projection 23 engages with an opposite end part of the locking arm 27, so that the first connector 4 is held in the holder body 17 of the holder 3. The first connector 4 is inserted into the holder body 17 of the holder 3 along the length direction of the terminal-receiving chamber and along an arrow S which is parallel to the axis of the holder body 17 of the holder 3. The arrow S denotes an insertion direction of the first connector 4 into the holder body 17 of the holder 3.

The plate 6 is made of a thick metal sheet and formed in a plate-shape. The plate 6 is provided with a locking part locking to the flange part 11 of the receiving part 9 at its one end part and a bolt-passing hole 32 for passing a bolt therethrough at its opposite end part. The plate 6 is placed on the flange part 11 on a condition that the locking part locks to the flange part 11 of the receiving part 9. The bolt-passing hole 32 communicates with a bolt-passing hole 16 formed on the flange part 11 of the receiving part 9.

The flange part 18 of the holder 3 is put between the plate 6 and the flange part 11 of the receiving part 9. The bolt 7 is screwed with a nut after passing through the bolt-passing holes 32 and 16, so that the plate 6 is attached to the flange part 11 of the receiving part 9. The flange part 18 of the holder 3 is put between the plate 6 and the flange part 11 of the receiving part 9, so that the plate 6 fixes the holder 3 to the receiving part 9.

The seat-side unit 40 is assembled as follows. First, the holder body 17 is inserted in the body part 10 of the receiving part 9 and the flange part 18 is placed on the flange part 11, so that the holder 3 is held by the receiving part 9.

Then, the plate 6 is placed on the flange part 18 of the holder 3 and fixed to the flange part 11 of the receiving part 9 by the bolt 7. Thereafter, as shown in FIG. 5, the first connector 4 is allowed to face an opening formed on the bottom plate 12, being spaced from the opening. Then, the first connector 4 is inserted into the holder body 17 of the holder 3, so that the first connector 4 is held in the holder body 17 as shown in FIG. 6. Thus, the seat-side unit 40 is assembled.

Figure 4:
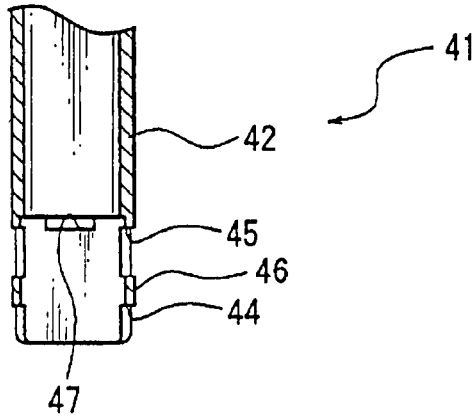
FIG. 4 is a cross sectional view taken along IV-IV line in FIG. 3.

As shown in FIG. 3, the head rest-side unit 41 includes a stay 42 as the second holder and the second connector 43. The stay 42 is attached to a head rest as the second article. The stay 42 is made of metal and formed in a tube-shape as a whole. As shown in FIGS. 3 and 4, the stay 42 includes a pair of notches 44, a pair of entrance-permitting holes 45, a part to be pressed 46, and a straight hole 47.

The notches 44 are arranged facing each other putting an axis of the stay 42 therebetween. The notch 44 is formed by notching a base material of the stay 42 from an end of the stay 42 toward the head rest.

The entrance-permitting holes 45 are arranged facing each other putting an axis of the stay 42 therebetween. The entrance-permitting holes 45 are arranged along the axis of the stay 42 together with the notches 44, being spaced from the notches 44. The entrance-permitting hole 45 is formed penetrating through the base material of the stay 42. When the connectors 4 and 43 are completely coupled with each other and the stay 42 is pressed onto the bottom plate 12, the locking projection 23 of the holder locking arm 21 enters the entrance-permitting hole 45. Thus, the entrance-permitting hole 45 allows the locking projection 23 of the holder locking arm 21, an engagement of which with the first connector 4 is removed, to enter therein after the connectors 4 and 43 are coupled with each other and the connectors 4 and 43 move with respect to the holder 3. The entrance-permitting hole 45 is the entrance-permitting part.

The part to be pressed 46 is a part located between the notch 44 lining up along the axis of the stay 42 and the entrance-permitting hole 45. The part to be pressed 46 is a part of an outer wall of the stay 42. When the connectors 4 and 43 move with respect to the holder 3 after the connectors 4 and 43 are coupled with each other, the locking projection 23 of the holder locking arm 21, an engagement of which with the first connector 4 is removed, abuts against the part to be pressed 46. The part to be pressed 46 is pressed by the locking projection 23 with a resilient restoring force of the arm body 22 of the holder locking arm 21.

The straight hole 47 extends straight along a direction crossing at right angles the axis of the stay 42. The straight hole 47 penetrates through the stay 42. When the connectors 4 and 43 are coupled with each other and the stay 42 is pressed onto the bottom plate 12 of the holder 3, the straight hole 47 communicates with the straight hole 14 and the straight notch 20.

Figure 7:
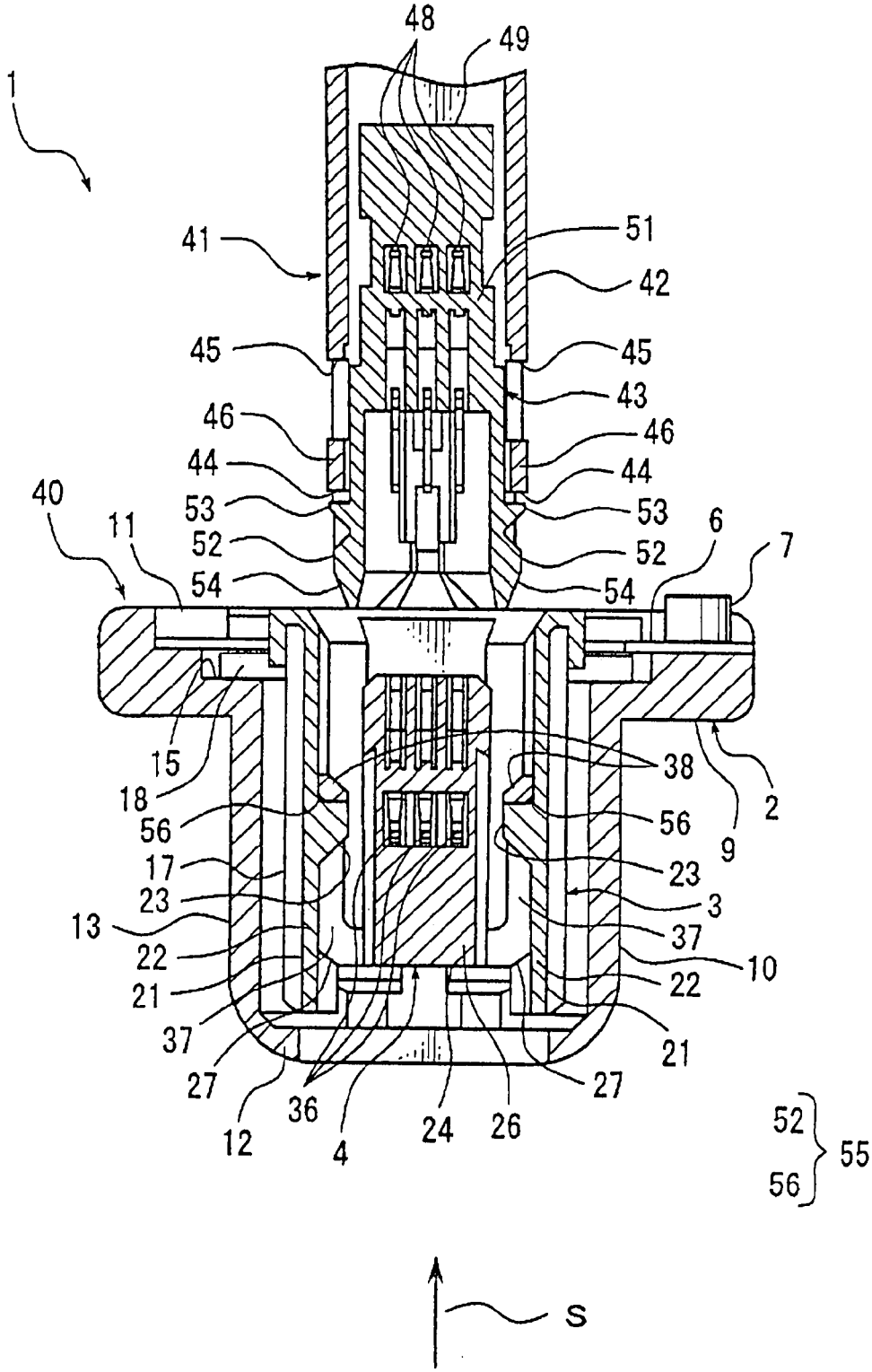
FIG. 7 is a cross sectional view illustrating a state when the seat-side unit and the head rest-side unit shown in FIG. 6 approach each other.

As shown in FIG. 7, the second connector 43 includes a terminal fitting 48 and connector housing 49. The terminal fitting 48 is made of electrically conductive sheet metal. The terminal fitting 48 is attached to an end of an electric wire 50, which is connected to various electronic equipment such as a monitor and a whiplash preventing apparatus, so as to be connected to a core wire of the electric wire 50.

The connector housing 49 is made of electrically insulating synthetic resin and includes a cylindrical housing body 51, a locking projection 52 as the second engaging part, and a pressing projection 53. The housing body 51 is provided with a plurality of terminal-receiving chambers. Each terminal-receiving chamber extends straight. A plurality of the terminal-receiving chambers are arranged in parallel to each other. The terminal-receiving chamber is a hole (space) provided within the housing body 51. The housing body 51 is received in an end part of the stay 42. When the housing body 51 is received in the stay 42, the second connector 43 is received in the stay 42 and attached to a head rest as the second article through the stay 42.

The connector housing 49 is provided with two locking projections 52. The locking projections 52 position the housing body 51 therebetween. The locking projection 52 is formed projecting from an end of the housing body 51, said end being situated near the seat-side unit 40. The locking projection 52 is provided with a tapered surface 54. The tapered surface 54 is inclined so that the tapered surface 54 gradually approaches the housing body 51, that is, an amount of projection of the locking projection 52 from the housing body 51 is gradually decreased as the tapered surface 54 approaches the seat-side unit 40. The locking arm 52 is positioned between a pair of the arm members 37 and the locking beak 38 of the locking arm 27 and engages with the locking arm 27. The locking arm 52 is engagable with the locking arm 27 and connects the connectors 4 and 43 to each other by engaging with the locking arm 27.

When the seat-side unit 40 and the head rest-side unit 41 are allowed to approach each other and the second connector 43 is inserted into the holder 3, the locking projection 52 abuts against the locking projection 23 of the holder locking arm 21 so as to allow the arm body 22 to be resiliently deformed in a direction in which the locking projection 23 goes away from the housing body 26 of the first connector 4. The locking projection 23 constructs the engagement-removing part 55 (explained later).

The connector housing 49 is provided with two pressing projections 53. The pressing projections 53 position the housing body 51 therebetween. Each pressing projection 53 is formed projecting from an end part of the housing body 51, said end part being situated near the seat-side unit 40, and arranged farther from the seat-side unit 40 than the locking projection 52 is arranged. The pressing projection 53 is arranged being spaced from the locking projection 52 and lined up along the axis of the stay 42 with the locking projection 52. When the second connector 43 is received in the stay 42, the pressing projection 53 is positioned in the notch 44 together with the locking projection 52.

The second connector 43 is received in an end part of the stay 42. After the locking projection 52, that is, the engagement-removing part 55 (explained later) removes an engagement between the holder locking arm 21 and the locking arm 27, the locking projection 52 engages with the opposite end of the locking arm 27, so that the second connector 43 couples with the first connector 4. Then, the second connector 43 is pressed onto the bottom plate 12 of the holder 3 together with the first connector 4.

The head rest-side unit 41 is assembled as follows. First, as shown in FIG. 3, the second connector 43 and the stay 42 are arranged along the axis of the stay 42 having a distance therebetween. Then, the second connector 43 is received in the stay 42, so that the head rest-side unit 41 is assembled.

The clip 5 is made of metal and as shown in FIGS. 1 and 2, integrally includes a straight part 29 formed in a straight bar-shape, a waved part 30 formed in a waved bar-shape arranged in parallel to the straight part 29, and an arc part 31 having a bar-shape extending in an arc-shape which connects ends of the straight part 29 and the waved part 30. The clip 5 is formed in a U-shape as a whole. The clip 5 is resiliently deformable in a direction in which the straight part 29 and the waved part 30 approach and leave each other. The straight part 29 enters into the is straight hole 14, straight notch 20 and straight hole 47, and body part 10 of the receiving part 9 and the holder 3 in the body part 10 are put between the waved part 30 and the straight part 29, so that the clip 5 is attached to the body part 10. When the straight part 29 enters into the straight hole 14, straight notch 20 and straight hole 47, the clip 5 positions the body part 10, the holder 3 and the stay 42, i.e. the connectors 4 and 43, relatively to one another.

Then, the straight part 29 is inserted into the straight hole 14, straight notch 20 and straight hole 47, and the body part 10 is put between the straight part 29 and the waved part 30, so that the clip 5 is attached to the receiving part 9, that is, to the seat-side unit 40 and the head rest-side unit 41 which are connected to each other.

The connector unit 1 includes the engagement-removing part 55, which includes the locking projection 52 and a tapered surface 56 provided to the locking beak 38 of the locking arm 27 of the first connector 4. The tapered surface 56 is provided at an edge part, which is on the side of the locking beak 38 situated away from the head rest-side unit 41 and at an edge part of the locking beak 38 located outside the connector housing 24 of the first connector 4. The tapered surface 56 is inclined in a direction in which the tapered surface 56 gradually approaches the housing body 26 of the connector housing 24 of the first connector 4 as the tapered surface 56 goes away from the head rest-side unit 41.

When the locking projection 52 engages with the locking arm 27, the engagement-removing part 55 presses the locking projection 23 of the holder locking arm 21 toward the outside so as to resiliently deforms the arm body 22 in a direction in which an engagement between the locking projection 23 and the locking arm 27 is removed. Then, when the head rest-side unit 41 is allowed to approach further the seat-side unit 40, the locking projection 23 of the holder locking arm 21 runs onto the tapered surface 56, so that the engagement between the holder locking arm 21 and the locking arm 27 is completely removed. Thus, when the locking arm 27 and the locking projection 52 engage with each other so that the connectors 4 and 43 are coupled with each other, the engagement-removing part 55 removes the engagement between the holder locking arm 21 and the locking arm 27 so as to allow the connectors 4 and 43 coupled with each other to move with respect to the holder 3.

The seat-side unit 40 and the head rest-side unit 41 are connected to each other as follows. First, the bracket 2 is attached to a seat and the stay 42 is attached to a head rest. Then, the straight part 29 of the clip 5 is inserted into the straight hole 14 and the straight notch 44, so that the clip 5 is attached to the seat-side unit 40. Thereafter, the seat and the head rest are allowed to approach each other. First, as shown in FIG. 6, the holder 3 and the second connector 43 are allowed to face each other and as shown in FIG. 7, the seat-side unit 40 and the head rest-side unit 41 are allowed to approach each other. At that time, off course, the holder locking arm 21 and the locking arm 27 are engaging with each other so that the first connector 4 is held in the holder 3.

Figure 8:
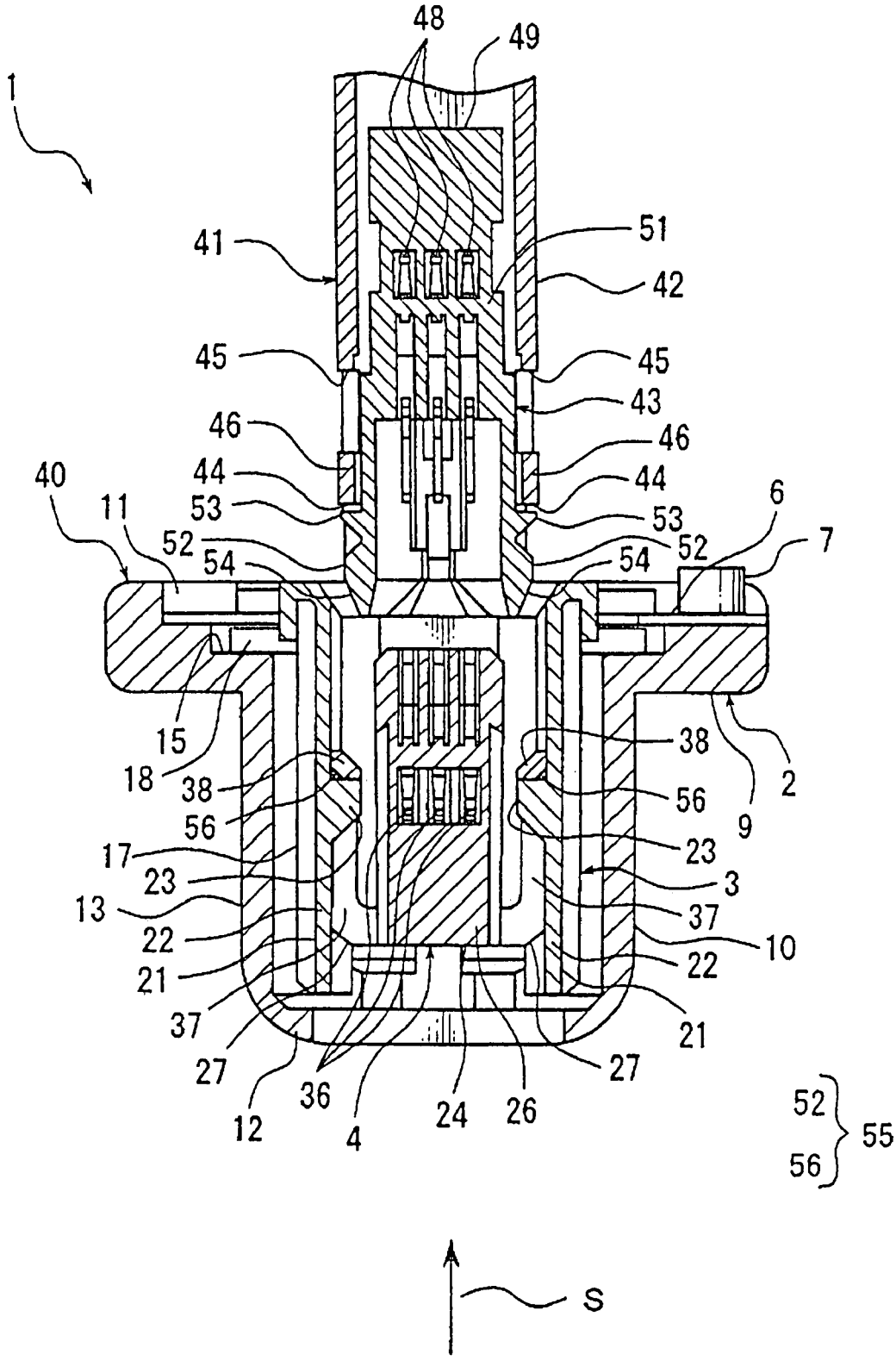
FIG. 8 is a cross sectional view illustrating a state when the second connector of the head rest-side unit enters the holder of the seat-side unit shown in FIG. 7.
Figure 9:
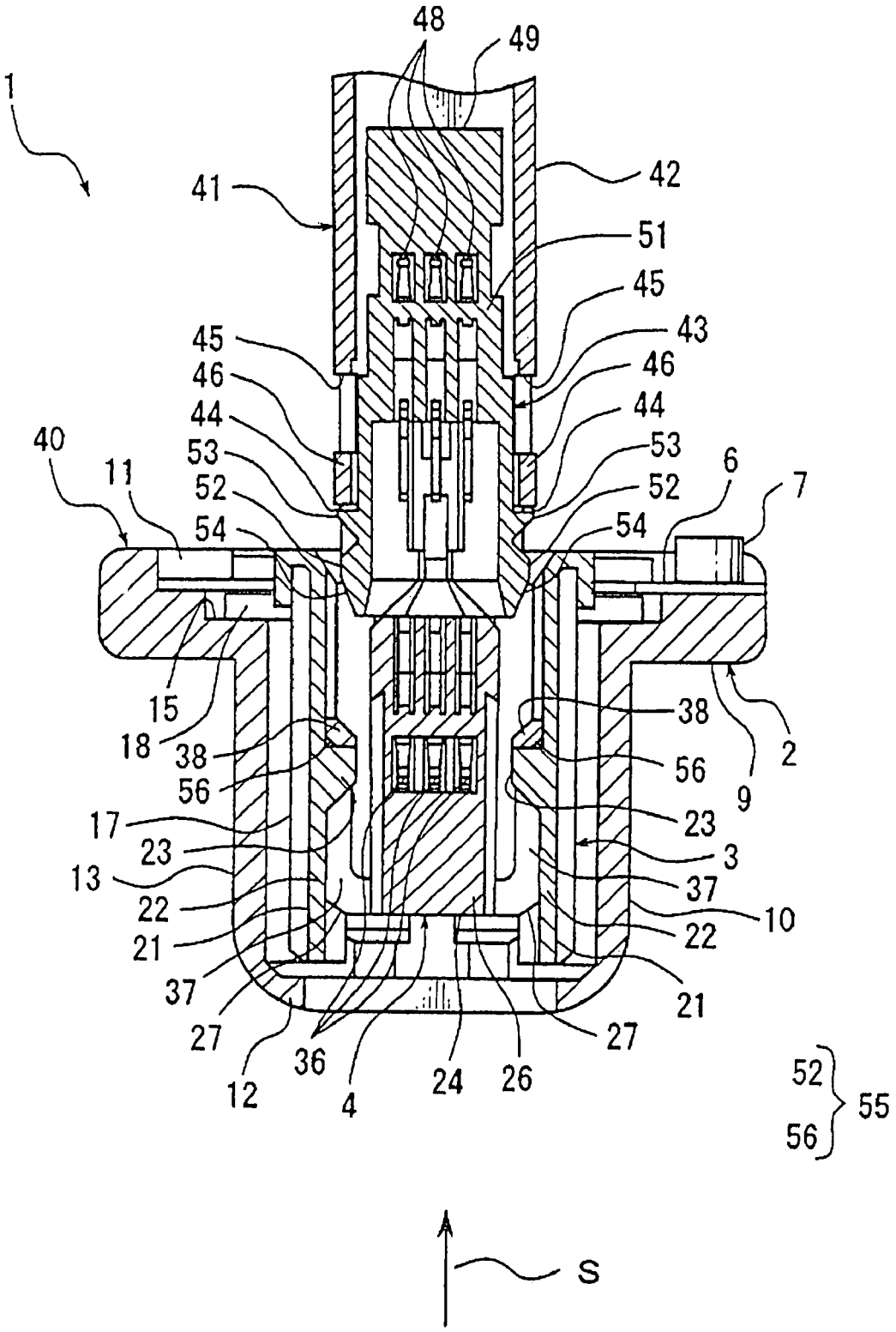
FIG. 9 is a cross sectional view illustrating a state when the second connector of the head rest-side unit further enters the depth of the holder of the seat-side unit shown in FIG. 8.
Figure 10:
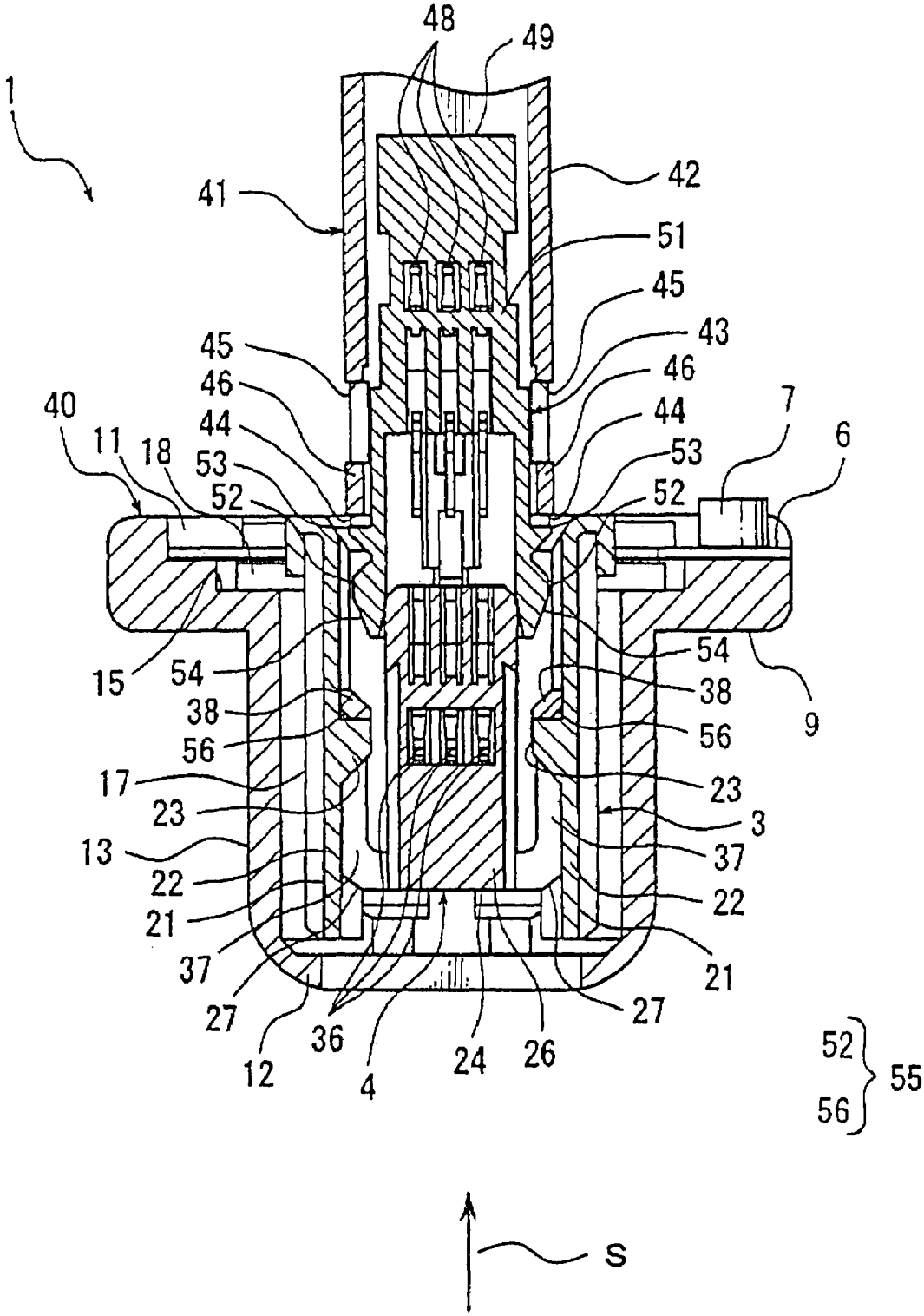
FIG. 10 is a cross sectional view illustrating a state when a housing body of the first connector of the seat-side unit shown in FIG. 9 enters the second connector of the head rest-side unit.
Figure 11:
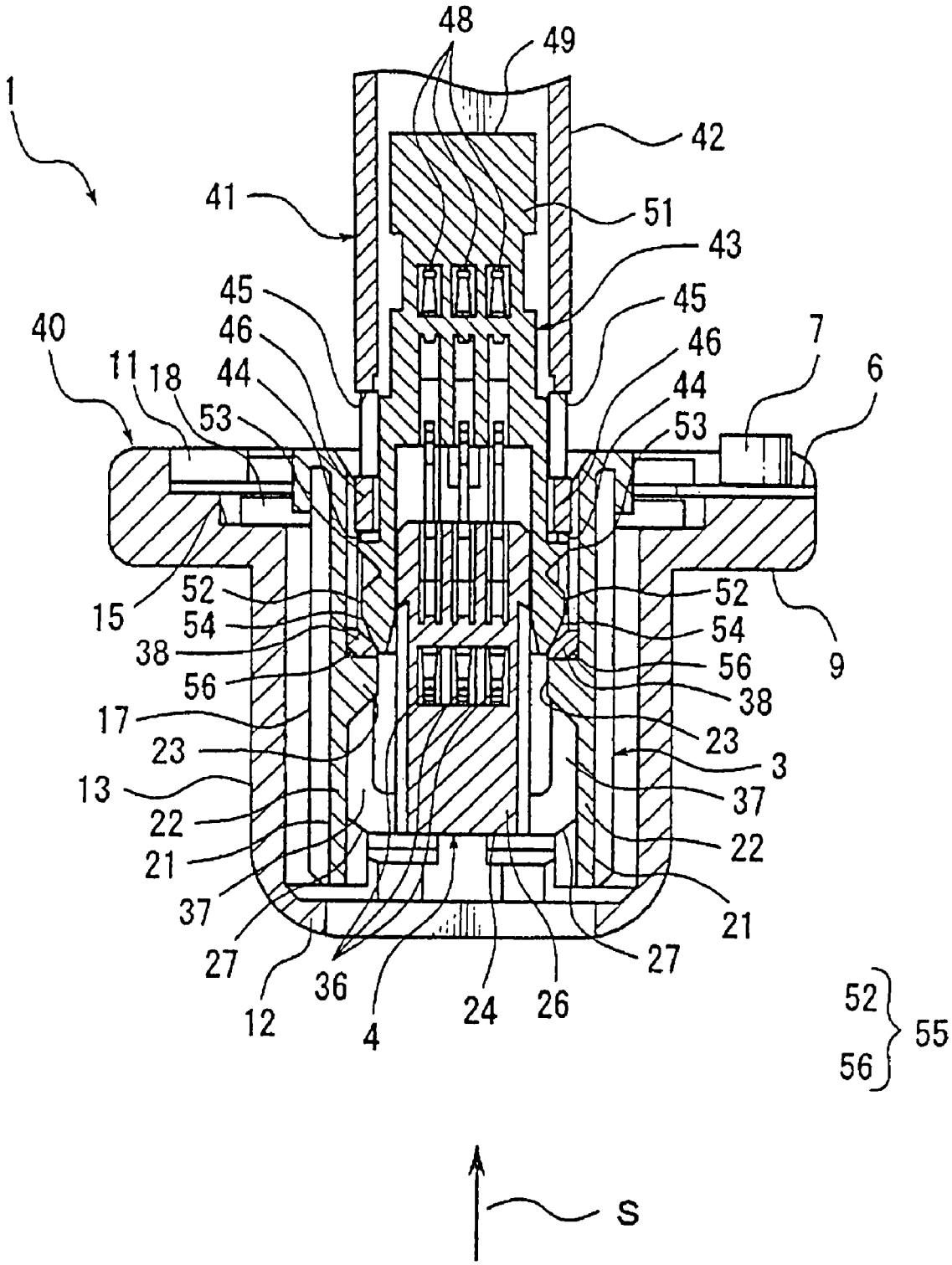
FIG. 11 is a cross sectional view illustrating a state when a locking projection of the second connector of the head rest-side unit abuts against a locking beak of the first connector of the seat-side unit shown in FIG. 10.

Then, as shown in FIGS. 8 and 9, the second connector 43 enters the holder 3. Thereafter, as shown in FIG. 10, the housing body 26 of the connector housing 24 of the first connector 4 enters the connector housing 49 of the second connector 43. Then, as shown in FIG. 11, the locking projection 52 of the second connector 43 comes in contact with the licking beak 38 of the locking arm 27 of the first connector 4. Then, the locking beak 38 is pressed by the tapered surface 54 of the locking projection 52, so that the locking arm 27 is resiliently deformed in a direction in which the locking beak 38 leaves from the housing body 26.

Figure 12:
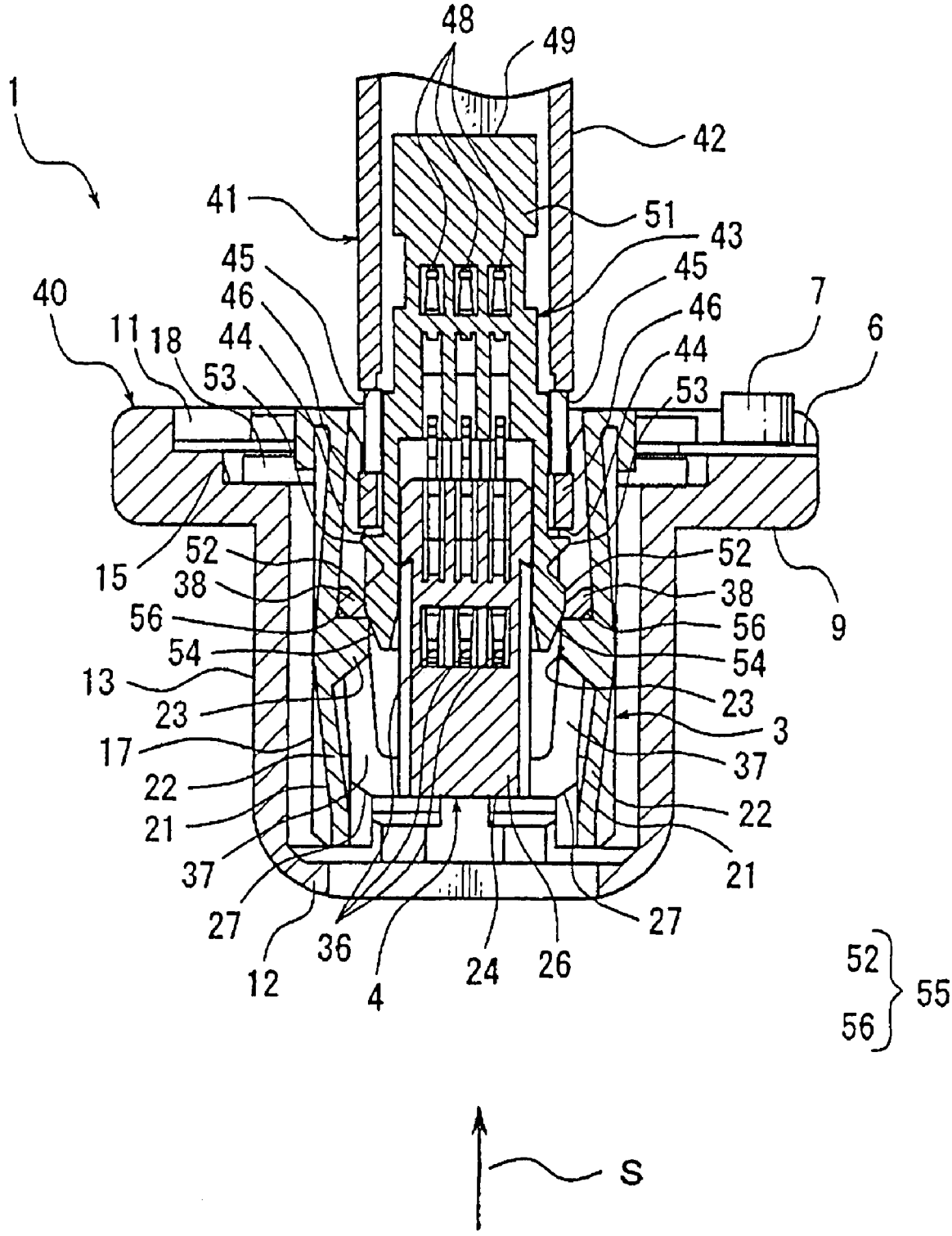
FIG. 12 is a cross sectional view illustrating a state when the locking beak of the first connector of the seat-side unit shown in FIG. 11 runs onto the locking projection of the second connector of the head rest-side unit.
Figure 13:
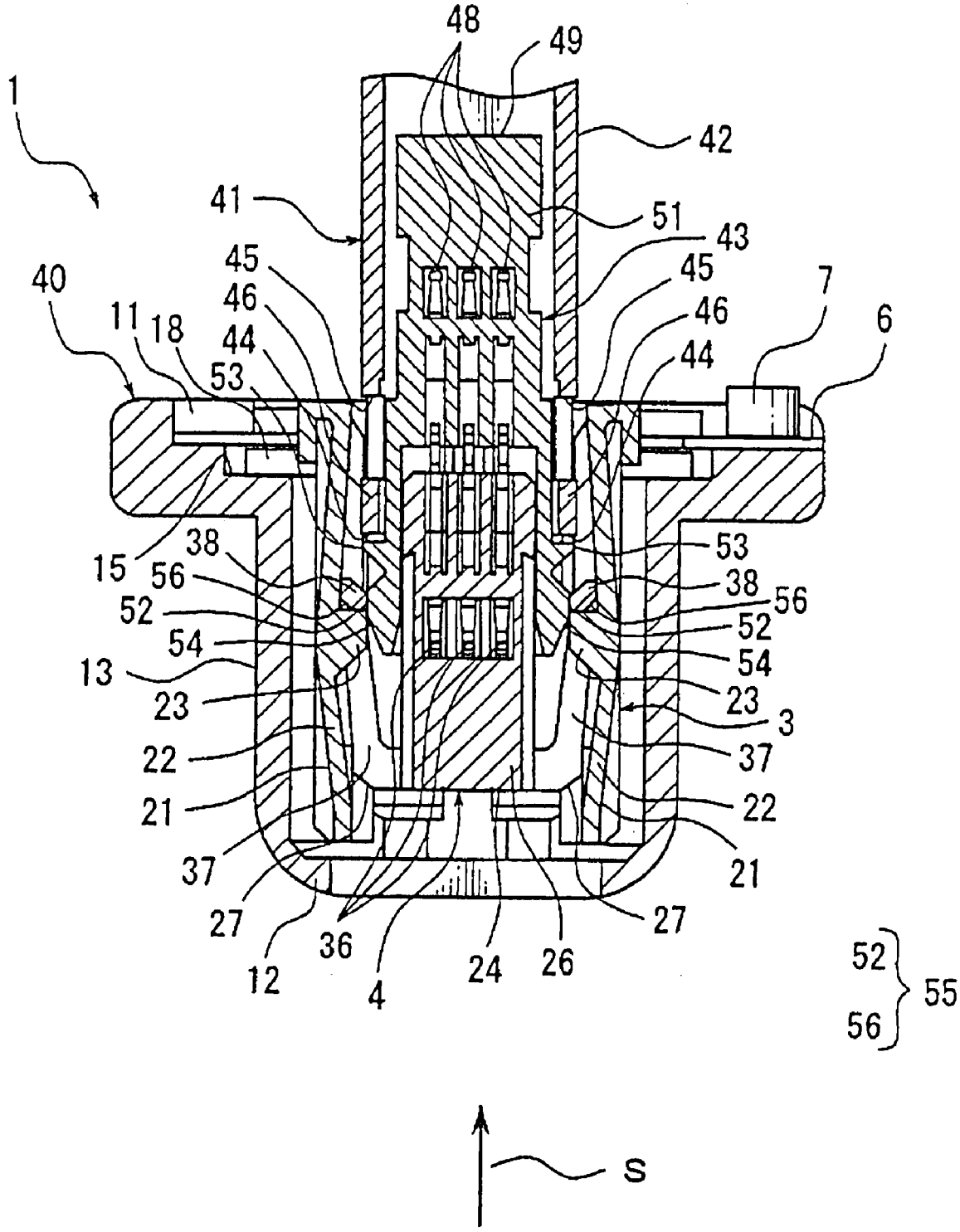
FIG. 13 is a cross sectional view illustrating a state when a locking projection of the holder of the seat-side unit shown in FIG. 12 runs onto the locking projection of the second connector of the head rest-side unit.
Figure 14:
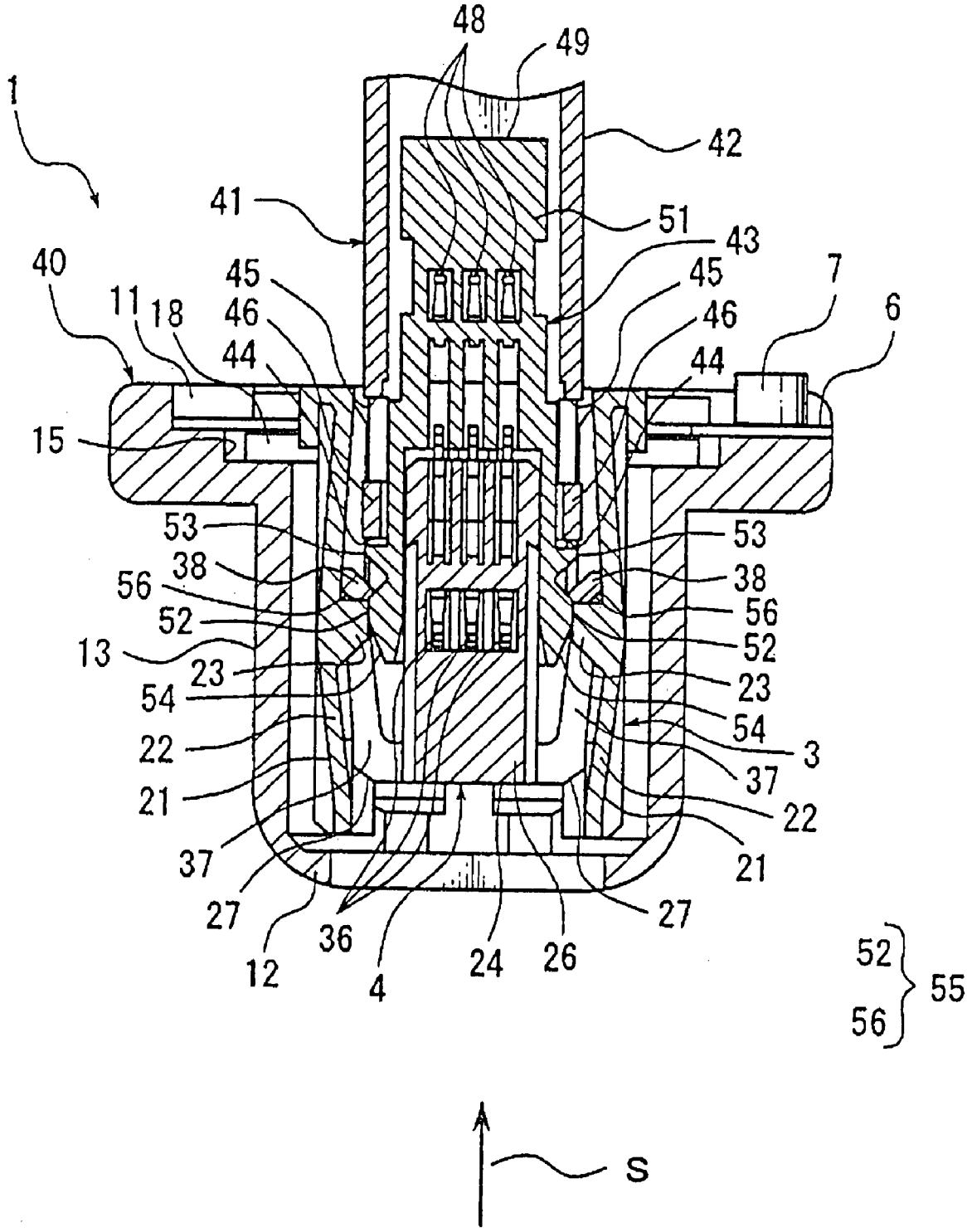
FIG. 14 is a cross sectional view illustrating a state when the locking beak of the first connector of the seat-side unit shown in FIG. 13 climbs over the locking projection of the second connector of the head rest-side unit.

Further, when the second connector 43 of the head rest-side unit 41 is inserted into the holder 3, as shown in FIG. 12, the locking projection 23 of the holder locking arm 21 runs onto the tapered surface 54 of the locking projection 52 and as shown in FIGS. 12-14, the locking projection 23 of the holder locking arm 21 runs onto the locking projection 52 of the second connector 43 together with the locking beak 38, so that holder locking arm 21 is resiliently deformed in a direction in which the locking projection 23 leaves from the housing body 26.

Figure 15:
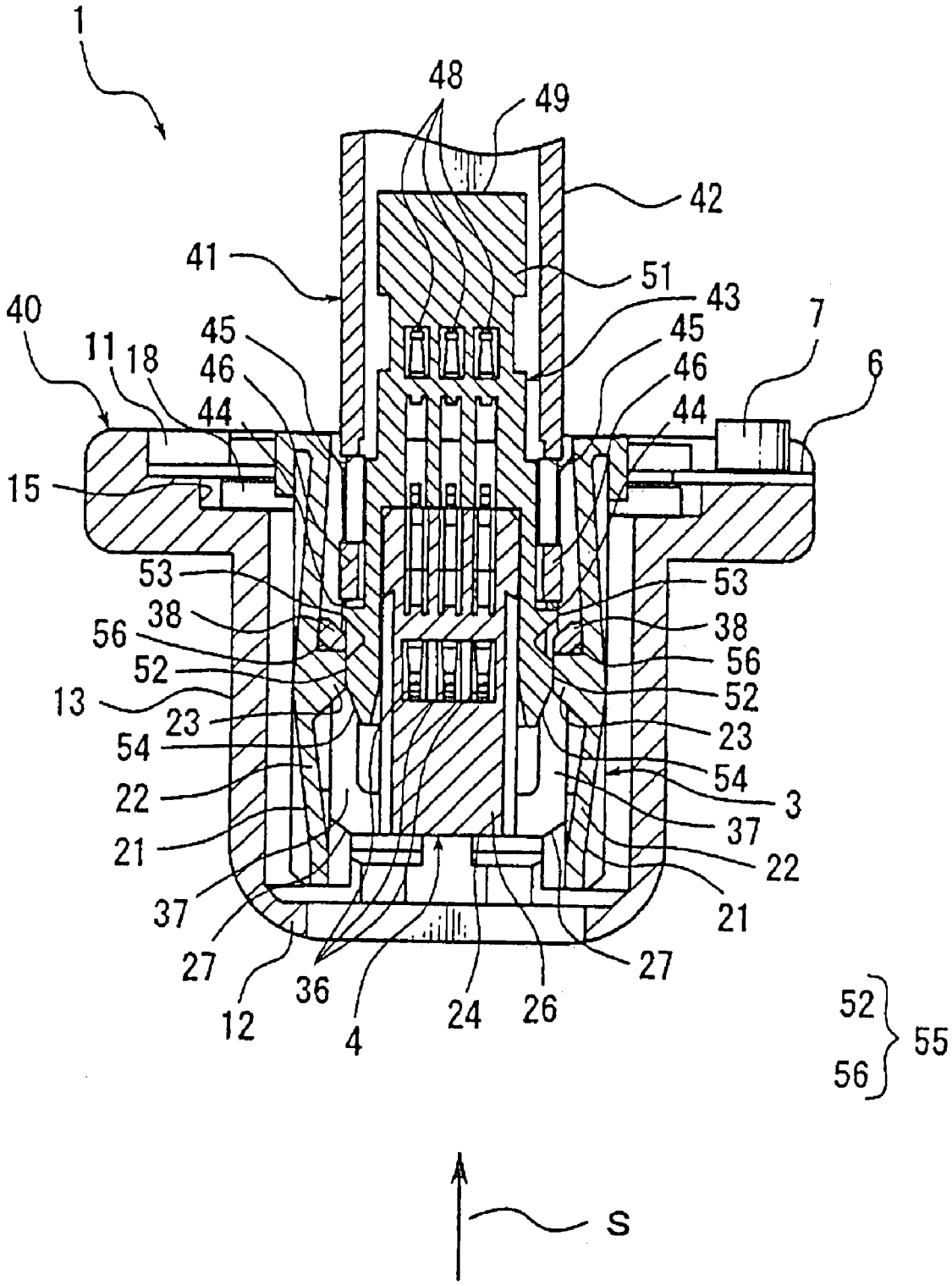
FIG. 15 is a cross sectional view illustrating a state when the first connector of the seat-side unit and the second connector of the head rest-side unit shown in FIG. 14 are coupled with each other.

Then, when the second connector 43 of the head rest-side unit 41 is inserted into the holder 3, as shown in FIG. 14, the locking beak 38 climbs over the locking projection 52 of the second connector 43. Then, the locking arm 27 is returning to its normal state in a direction in which the locking beak 38 approaches the housing body 26. Then, as shown in FIG. 15, the locking arm 27 returns to its normal state, so that the locking arm 27 and the locking projection 52 engage with each other, that is, the connectors 4 and 43 engage with each other, and the locking projection 23 of the holder locking arm 21 climbs over the locking projection 52 of the second connector 43, so that the engagement between the holder locking arm 21 and the locking arm 27 is removed.

Figure 16:
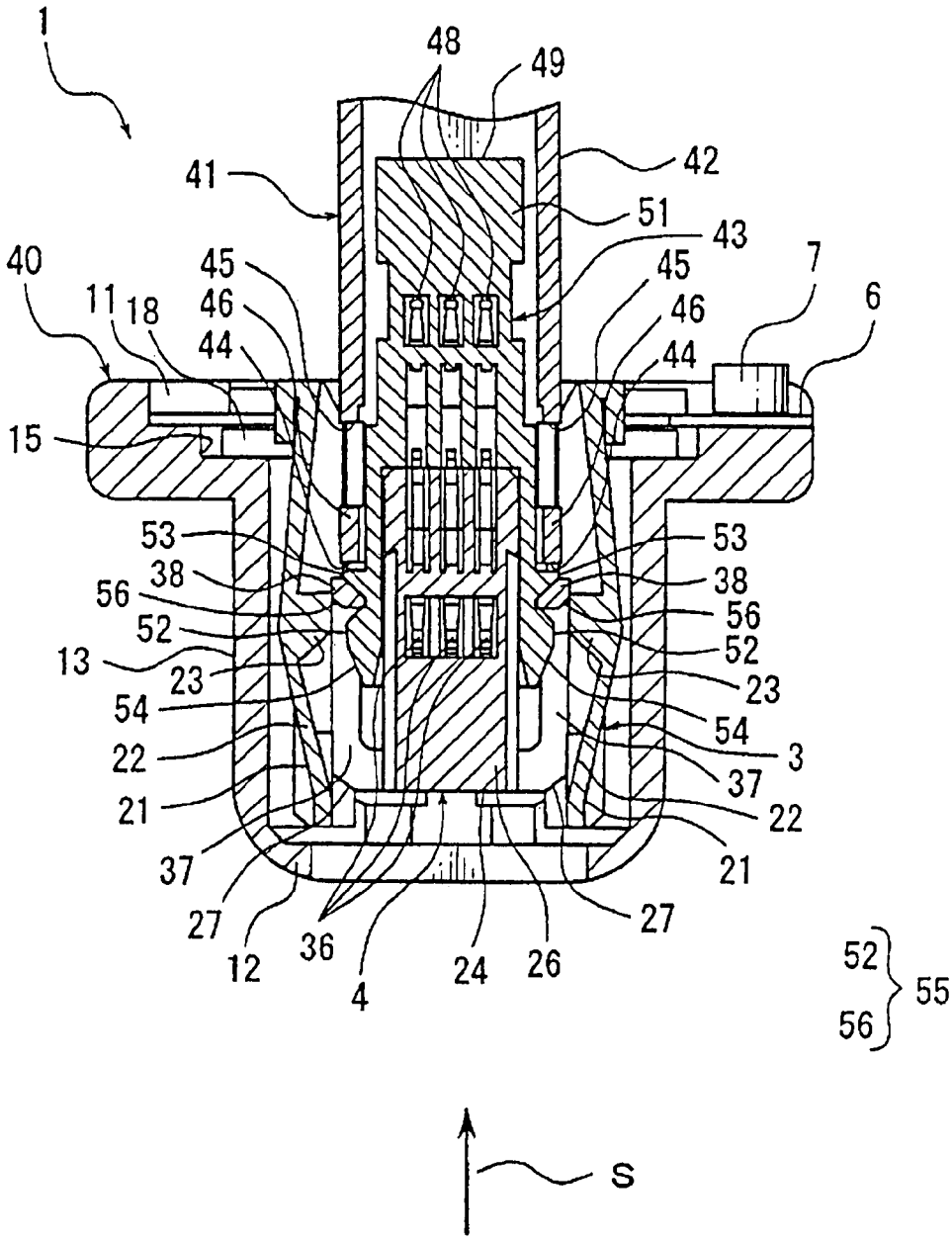
FIG. 16 is a cross sectional view illustrating a state when an engagement between a holder locking arm of the holder of the seat-side unit and a locking arm of the first connector shown in FIG. 15 is completely removed.
Figure 17:
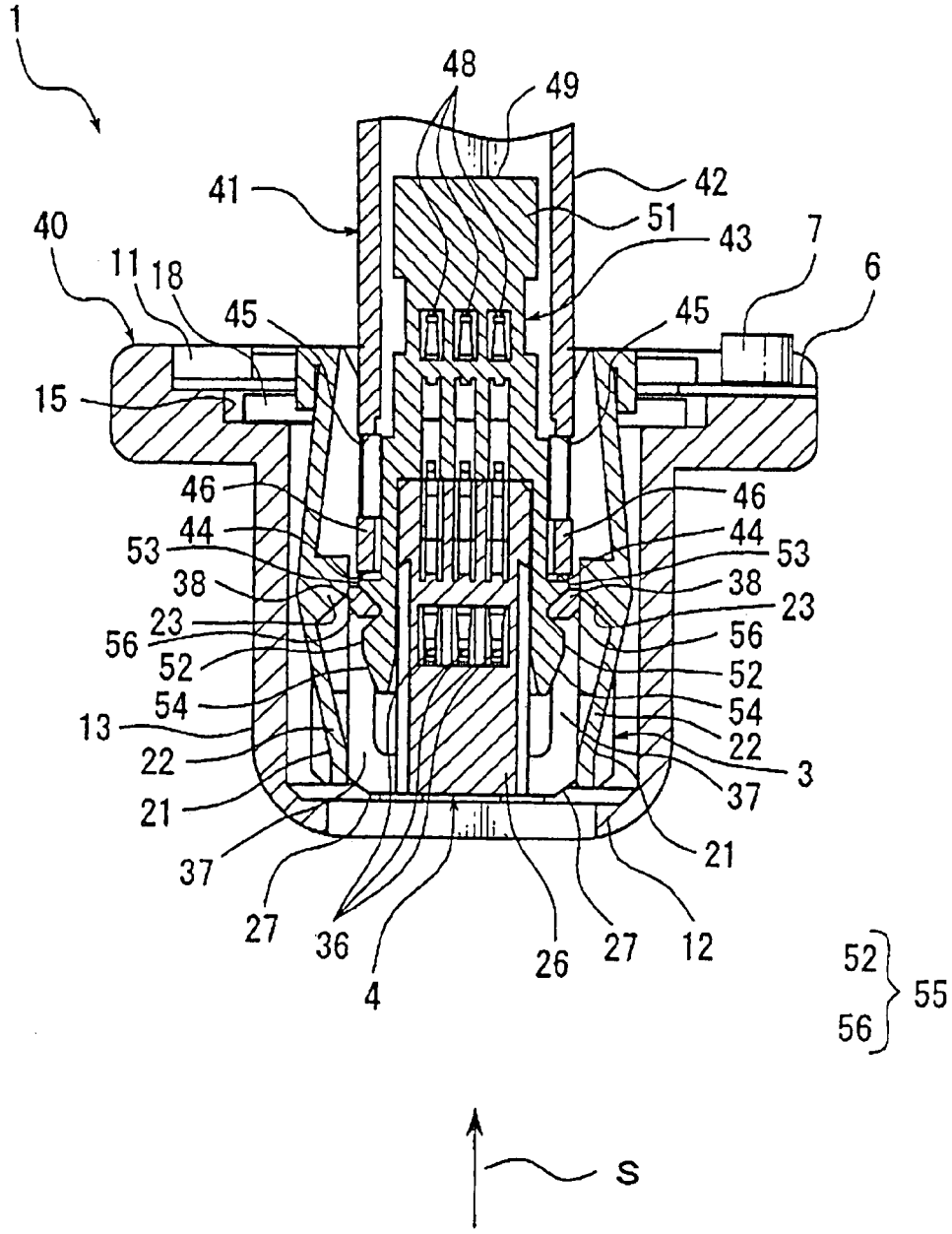
FIG. 17 is a cross sectional view illustrating a state when the locking projection of the holder locking arm of the holder of the seat-side unit shown in FIG. 16 runs onto the locking beak of the first connector.

Further, when the second connector 43 of the head rest-side unit 41 is inserted into the holder 3, the pressing projection 53 presses the locking beak 38 and as shown in FIG. 16, the locking projection 23 of the holder locking arm 21 slides on the tapered surface 56 of the locking beak 38, so that the locking projection 23 runs onto the locking beak 38 of the locking arm 27. Thus, the engagement between the holder locking arm 21 and the locking arm 27 is completely removed, so that the connectors 4 and 43 engaged with each other becomes movable in the holder 3. Thereafter, as shown in FIG. 17, the locking projection 23 of the holder locking arm 21 slides on the locking beak 38 of the locking arm 27, so that the locking projection 23 of the holder locking arm 21 completely climbs over the locking beak 38 of the locking arm 27 as shown in FIG. 18.

Figure 18:
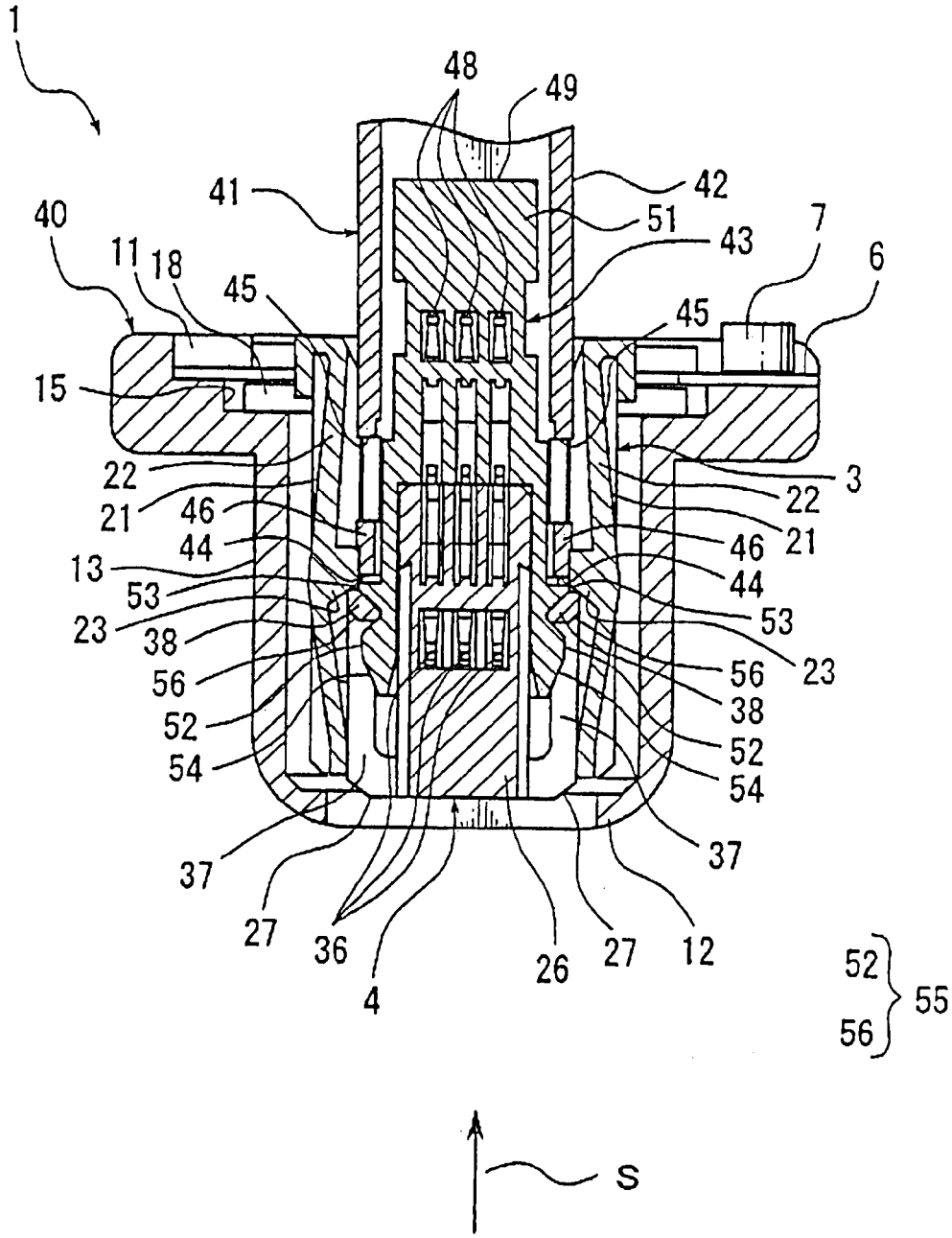
FIG. 18 is a cross sectional view illustrating a state when the locking projection of the holder locking arm of the holder of the seat-side unit shown in FIG. 17 runs onto a part to be pressed of a stay of the head rest-side unit.
Figure 19:
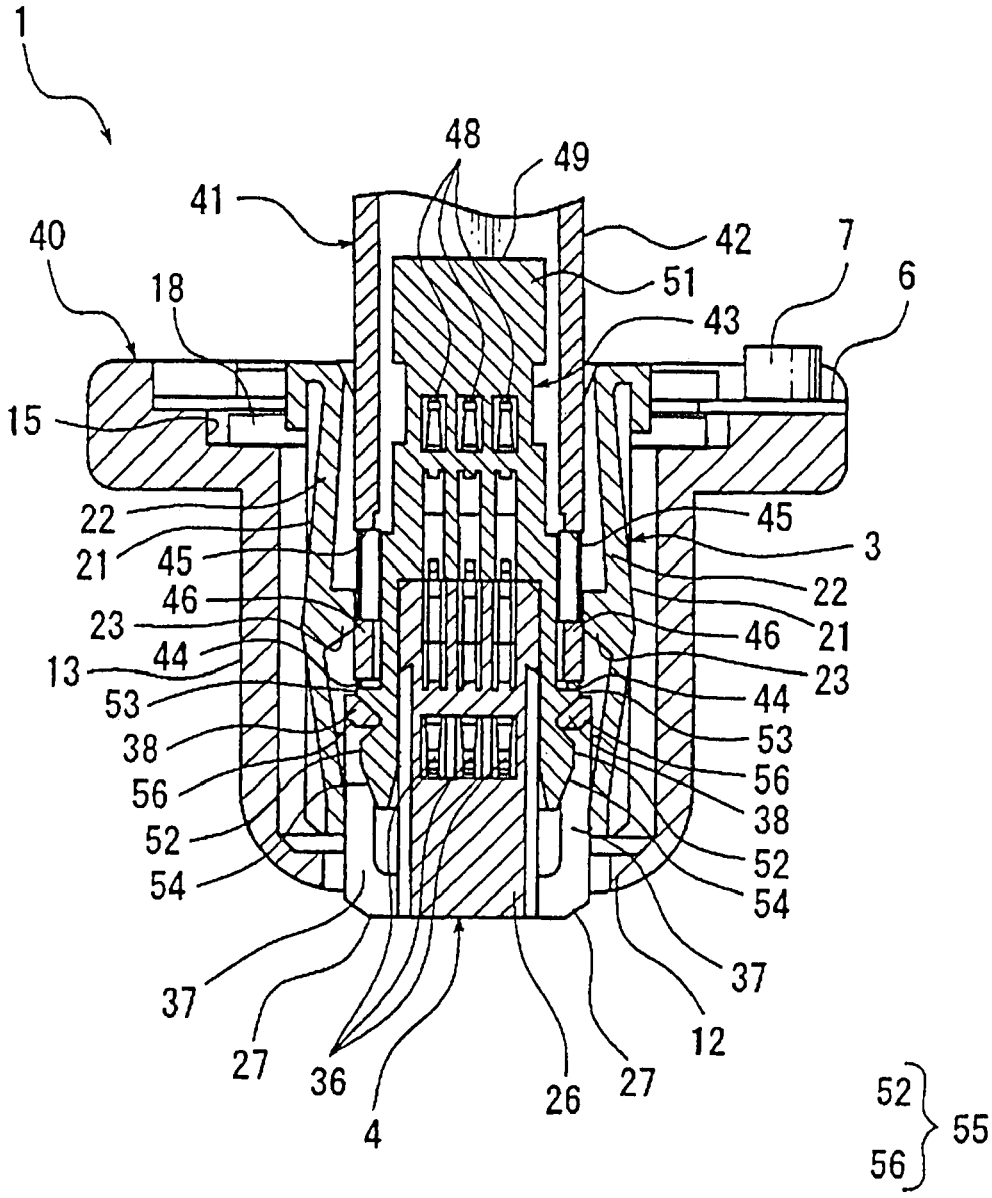
FIG. 19 is a cross sectional view illustrating a state when the second connector of the heat rest-side unit further enters the depth of the holder of the seat-side unit shown in FIG. 18.
Figure 20:
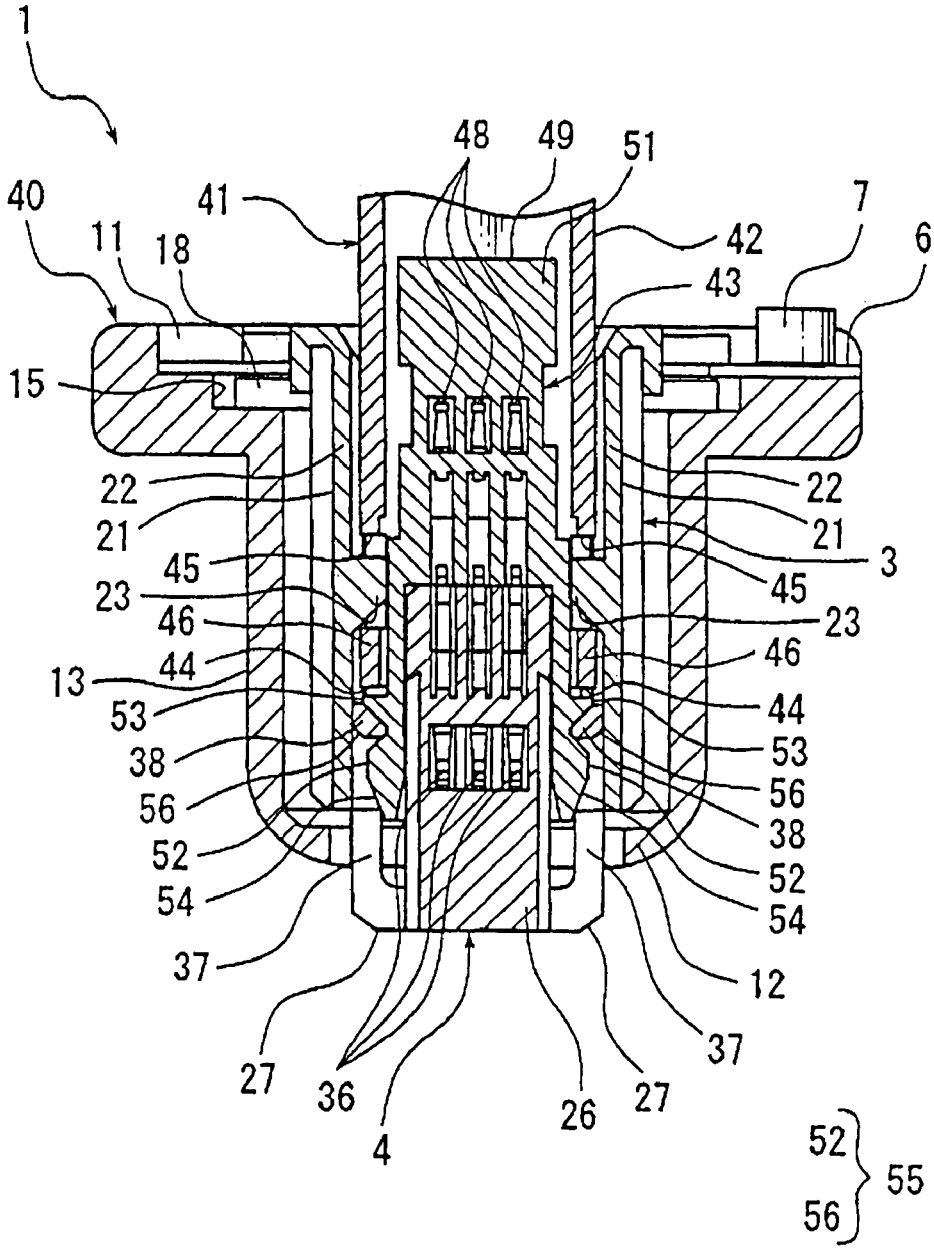
FIG. 20 is a cross sectional view illustrating a state when the locking projection of the holder locking arm of the holder of the seat-side unit shown in FIG. 19 enters an entrance-permitting part of a stay of the head rest-side unit.

Then, as shown in FIG. 18, the locking projection 23 of the holder locking arm 21 abuts against the part to be pressed 46 of the stay 42, so that the locking projection 23 of the holder locking arm 21 presses the part to be pressed 46 toward the inside of the body part 10 of the receiving part 9, i.e. toward the inside of the stay 42, with a resilient restoring force of the arm body 22. Further, when the second connector 43 of the head rest-side unit 41 is inserted into the holder 3, as shown in FIG. 19, the locking projection 23 of the holder locking arm 21 slides on the part to be pressed 46 and as shown in FIG. 20, the locking projection 23 of the holder locking arm 21 climbs over the part to be pressed 46 so as to enter the entrance-permitting hole 45. When the locking projection 23 enters the entrance-permitting hole 45, as shown in FIG. 20, the arm body 22, i.e. the holder locking arm 21 returns to its normal non-resiliently deformed state. Further, as shown in FIG. 20, an end part of the connector housing 24 of the first connector 4 projects toward the outside of the holder 3, said end part being situated away from the head rest-side unit 41.

Then, the straight part 29 of the clip 5 enters the straight hole 47, so that the clip 5 positions the body part 10 of the receiving part 9, the holder 3 and the stay 42 relatively to each other and positions the connectors 4 and 43 engaged with each other relatively to the holder 3. Thus, in the connector unit 1, the units 40 and 41 are connected to each other, i.e. the connectors 4 and 43 are engaged with each other, and the clip 5 supports a load from the stay 42. When the connectors 4 and 43 are engaged with each other, of course, the terminal fittings 36 and 48 are connected to each other. Thus, the connector unit 1 connects the electronic equipment located on the vehicle-side of a motor vehicle and the electronic equipment attached to the head rest to each other so as to supply desired electric power and signals to the electronic equipment attached to the head rest.

In the preferred embodiment described above, the stay 42 is provided with the entrance-permitting hole 45, into which the locking projection 23 of the holder locking arm 21 enters when the connectors 4 and 43 are engaged with each other so that the seat and the head rest are assembled with each other. Therefore, even if the holder locking arm 21 is being resiliently deformed when the connectors 4 and 43 are engaged with each other, the locking projection 23 enters the entrance-permitting hole 45 so as to prevent the holder locking arm 21 from being resiliently deformed. Therefore, the holder locking arm 21 can be prevented from being plastically deformed, and even if the seat and the head rest are disassembled from each other, the holder locking arm 21 securely engages with the first connector 4, so that the first connector 4 can be prevented from dropping out from the holder 3.

The stay 42 is provided with the part to be pressed 46 which is pressed by the locking projection 23 of the holder locking arm 21 when the seat and the head rest are assembled with each other. Therefore, the holder 3 and the stay 42 can be easily aligned with each other when the seat and the head rest are assembled with each other. Therefore, the seat and the head rest can be easily positioned at the respective predetermined relative positions.

Since the first connector 4 and the second connector 43 include the locking arm 27 and the locking projection 52, respectively, the first connector 4 can be securely held in the holder 3 and the connectors 4 and 43 can be securely kept being engaged with each other. Therefore, the connectors 4 and 43 can be prevented from abruptly dropping out.

Figure 21:
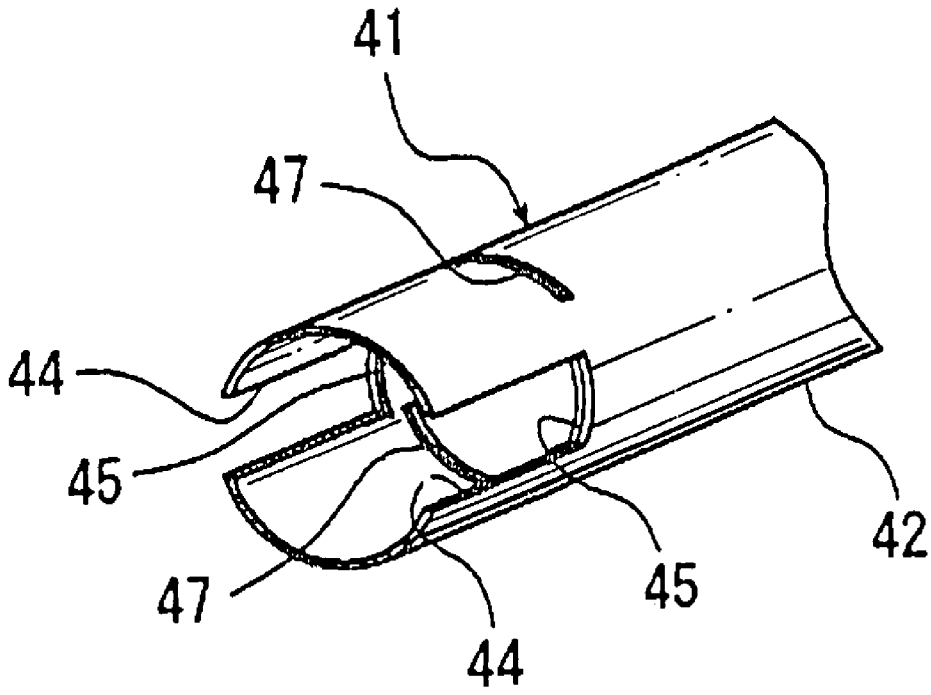
FIG. 21 is a perspective view of another preferred embodiment of a stay of the head rest-side unit shown in FIG. 4.

In the preferred embodiment described above, the seat as the first article, the head rest as the second article, and the connector unit 1, which supplies desired signals and so on to the electronic equipment attached to the head rest, are shown. However, instead, an article except the seat as the first article (or an article except an article mounted on a motor vehicle) and an article except the head rest as the second article (or an article except an article mounted on a motor vehicle) may be used so that desired signals and so on are supplied to the electronic equipment attached to the second article. Further, the entrance-permitting part may be a recess which is concave from an outer peripheral surface of the stay 42, said recess not penetrating through the stay 42. Furthermore, as shown in FIG. 21, the notch 44 may communicate with the entrance-permitting hole 45.

The aforementioned preferred embodiments are described to aid in understanding the present invention and variations may be made by one skilled in the art without departing from the spirit and scope of the present invention.

What is claimed is:

1. A connector unit comprising:

a first holder to be attached to a first article;

a first connector to be received in the first holder;

a second holder to be attached to a second article; and a second connector to be received in the second holder so as to be coupled with the first connector, wherein the first holder includes a hold engaging part having an arm body and a projection, which projects from the arm body toward the first connector and engages with the first connector, the connector unit further comprising:

an engagement-removing part which removes an engagement between the hold engaging part and the first connector when the first and second connectors are coupled with each other, so as to allow the first and second connectors to move with respect to the first holder; and an entrance-permitting part which is provided on the second holder so as to allow the projection of the hold engaging part, the engagement of which with the first connector is removed, to enter therein after the first and second connectors move with respect to the first holder.

2. The connector unit according to claim 1 further comprising a part to be pressed which is formed in the second holder and is pressed by the projection of the hold engaging part, the engagement of which with the first connector is removed, when the first and second connectors move with respect to the first holder after the first and second connectors are coupled with each other.

3. The connector unit according to claim 1, wherein the first connector includes a first engaging part which is engagable with the hold engaging part and holds the first connector in the first holder by engaging with the hold engaging part, wherein the second connector includes a second engaging part which is engagable with the first engaging part and causes the first and second connectors to couple with each other by engaging with the first engaging part, wherein the engagement-removing part removes an engagement between the hold engaging part and the first engaging part when the first and second engaging parts engage with each other, so as to allow the first and second connectors engaging with each other to move with respect to the first holder.

4. The connector unit according to claim 2, wherein the first connector includes a first engaging part which is engagable with the hold engaging part and holds the first connector in the first holder by engaging with the hold engaging part, wherein the second connector includes a second engaging part which is engagable with the first engaging part and causes the first and second connectors to couple with each other by engaging with the first engaging part, wherein the engagement-removing part removes an engagement between the hold engaging part and the first engaging part when the first and second engaging parts engage with each other, so as to allow the first and second connectors engaging with each other to move with respect to the first holder.

* * * * *